US008054147B2

(12) United States Patent
Hays et al.

(10) Patent No.: US 8,054,147 B2
(45) Date of Patent: Nov. 8, 2011

(54) HIGH VOLTAGE SWITCH AND METHOD OF MAKING

(75) Inventors: David Cecil Hays, Gainesville, FL (US); Christopher Fred Keimel, Schenectady, NY (US); Marco Francesco Aimi, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 295 days.

(21) Appl. No.: 12/416,292

(22) Filed: Apr. 1, 2009

(65) Prior Publication Data

US 2010/0252403 A1 Oct. 7, 2010

(51) Int. Cl.
*H01P 1/10* (2006.01)
*H01H 57/00* (2006.01)

(52) U.S. Cl. ..... 333/262; 333/105

(58) Field of Classification Search ..... 333/101, 333/105, 262

See application file for complete search history.

(56) References Cited

U.S. PATENT DOCUMENTS

| | | | | |
|---|---|---|---|---|
| 5,619,061 | A * | 4/1997 | Goldsmith et al. | 333/101 |
| 6,391,675 | B1 | 5/2002 | Ehmke et al. | |
| 6,483,223 | B2 | 11/2002 | Samper et al. | |
| 6,639,488 | B2 | 10/2003 | Deligianni et al. | |
| 7,176,068 | B2 | 2/2007 | Kitakado et al. | |

FOREIGN PATENT DOCUMENTS

| | | | |
|---|---|---|---|
| JP | 05048101 | A2 | 2/1993 |
| JP | 05048102 | A2 | 2/1993 |
| JP | 23045887 | A2 | 2/2003 |
| WO | 2006012253 | A1 | 2/2006 |

* cited by examiner

*Primary Examiner* — Dean Takaoka
(74) *Attorney, Agent, or Firm* — Richard D. Emery

(57) ABSTRACT

Electrostatic devices, systems and methods are presented. One embodiment is an electrostatic device including a substrate, a first electrode disposed on the substrate, a movable element having a second electrode and a control electrode. The control electrode is disposed in electrostatic communication with the movable element. The control electrode includes a protection layer having resistivity in a range of from about 1 ohm-cm to about 10 kohm-cm.

21 Claims, 1 Drawing Sheet

HIGH VOLTAGE SWITCH AND METHOD OF MAKING

BACKGROUND

Figure 1:
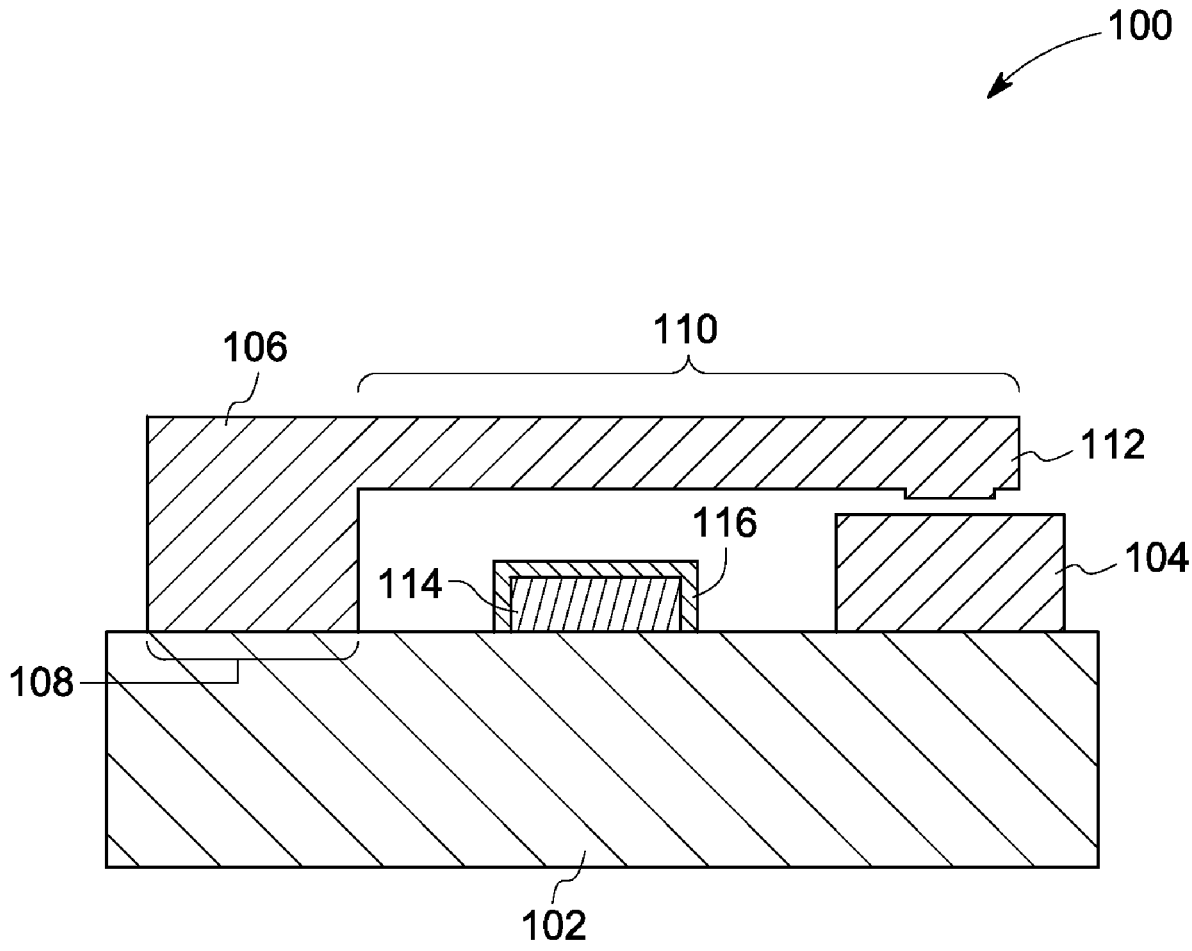

The invention relates generally to micro-electromechanical systems (MEMS) for high voltage switching applications. More particularly, the invention relates to highly resistive gate electrodes for MEMS devices, and devices incorporating such gate electrodes. The invention also relates to method of making such MEMS devices.

Microelectromechanical systems (MEMS) devices are being developed for an enormous variety of industrial and medical applications because these device have several potential advantages, including low cost, high reliability, and performance advantages achieved through miniaturization. Potential applications include actuators, sensors, switches, accelerometers, modulators and other micro-devices. MEMS devices integrate electrical and mechanical components that are generally fabricated using integrated circuit processing technologies.

Emergence of MEMS technologies has brought global attention to the possibility of merging conventional macroscopic relay attributes with MEMS device attributes to produce MEMS based relays/switches. MEMS switches have advantages over their conventional counterparts. The potential for high power efficiency, low insertion loss, excellent isolation, and ability to integrate with other electronics makes microswitches an attractive alternative to traditional mechanical and solid state switches. Most MEMS based relays/switches have been developed for signal switching applications and a few for power applications.

One well-known type of MEMS switch operates through the electrostatic actuation of a beam or cantilever to achieve physical contact with an electrode. The beam is deflected electrostatically by an actuation or gate electrode. The electrostatic forces due to the electric field between the beam and the gate electrode can generate relatively large forces in the small separations. Thus, in the actuated state, there is a chance that the beam may touch the gate electrode and short the device. To avoid any contact, the gate electrode may use a dielectric layer deposited over the conductive material, thereby insulating the gate from the beam. The choice of dielectric is constrained by switching properties such as actuation voltage and the field across the dielectric. For example, the dielectric should have higher breakdown voltage than the field across the dielectric.

Conventionally, the dielectric layers are deposited over gate conductive material by using vapor deposition methods such as plasma enhanced chemical vapor deposition (PECVD). These layers are generally of low quality and may be easily attacked by the processing and operating environments.

While the dielectric layer serves the above purpose, the layer may also experience a dielectric charging phenomenon. Over time and cycles of actuation, a charge may accumulate within the layer and build up a field that screens the applied field. This alters the gate voltage required to actuate the switch, which may cause inaccuracy and failure of the switch.

Thus, there is a need to provide an improved dielectric material for MEMS devices. There is a further need for MEMS devices for high voltage switches with improved properties as compared to conventional switches. Moreover, there is a need for methods to produce such dielectric layers and MEMS devices.

BRIEF DESCRIPTION

One embodiment is a device comprising a substrate, a first electrode disposed on the substrate, a movable element comprising a second electrode and a control electrode comprising a protection layer. The control electrode is disposed in electrostatic communication with the movable element. The protection layer has resistivity in a range of from about 1 ohm-cm to about 10 kohms-cm.

Another embodiment is a system, comprising a plurality of electrostatically activated devices. Each of the electrostatically activated devices comprises a substrate, a first electrode disposed on the substrate, a movable element comprising a second electrode and a control electrode comprising a protection layer. The control electrode is disposed in electrostatic communication with the movable element. The protection layer has resistivity in a range of from about 1 ohm-cm to about 10 kohms-cm.

Further embodiment is a method of making an electrostatically activated device. The method comprises providing a substrate, a first electrode disposed on the substrate; a movable element comprises a second electrode and a control electrode comprising a protection layer. The control electrode is disposed in electrostatic communication with the movable element. The protection layer has resistivity in a range of from about 1 ohm-cm to about 10 kohms-cm.

DRAWINGS

FIG. 1 is a schematic cross section of a device in accordance with one embodiment of the present invention.

DETAILED DESCRIPTION

As discussed in detail below, embodiments of the present invention include resistive gate electrode and device that incorporate such gate electrodes.

As used herein, the term "switch" refers to a device that can be used to connect and disconnect two parts of an electrical component. The mechanism of operation of such switches may be mechanical, or it may be electrical, or it may be chemical, or it might be a combination of the above. A suitable non-limiting example of such a switch is a micro-electromechanical switch.

As used herein, the term "open," when used in the context of discussion of an amount of communication and/or a state of electrical contact between two electrical contact surfaces refers to the situation wherein no or negligible amount of electrical current flows between the two electrical contact surfaces. In similar vein, as used herein, the term "closed," when used in the context of discussion of an amount of communication and/or a state of electrical contact between two electrical contact surfaces, refers to the situation wherein an amount of electrical current that is significant in the given situation flows between the two electrical contact surfaces.

According to an embodiment of the invention, FIG. 1 schematically illustrates a device 100. The device 100 includes a substrate 102, a first electrode 104 disposed on the substrate 102, a movable element 106 and a control electrode 114. The moveable element 106 is attached to the substrate 102 and includes a second electrode 112. The control electrode 114 is disposed in electrostatic communication with the movable element 106 and includes a protection layer 116. The protection layer 116 has resistivity in a range from about 1 ohm-cm to about 10 kohms-cm.

In one particular embodiment, the device is a high voltage switch that may be operable at a voltage higher than 25 Volts. In one embodiment, the switch may be operable in a voltage range from about 25 Volts to about 100 volts. In a particular embodiment, the operable voltage may be greater than about 100 volts, including, in certain cases, greater than about 200 volts. In power electronic application the switch may be limited by the available system voltage which could be as high as 480V and even 600V. In some embodiments, the operable voltage of the switch may be in a range from about 200 volts to about 600 volts.

In some embodiments, the device is a microelectromechanical systems (MEMS) device. The MEMS device is composed of microscale subsystems. The subsystems, generally, have dimensions less than about 50 microns. In alternate embodiments, the device is a nanoelectromechanical systems (NEMS) device. The NEMS device is a nanotechnology based nanodevice that contains nanoscale subsystems having a largest dimension less than about 1 micron.

In the illustrated embodiment, the substrate 102 defines a planar surface upon which the device is constructed. The substrate 102 may be formed of insulating material. In one embodiment, the insulating material for the substrate may include a semiconductor such as silicon, gallium arsenide, indium phosphide or the like. A silicon wafer is a particular example of a suitable substrate material. Alternately, suitable ceramic materials such as, but not limited to, alumina, beryllium oxide or glass may serve as the substrate. Optionally, an insulating layer, such as silicon dioxide may be placed on top of the substrate to further insulate the movable element, the first electrode, the control electrode, input/output connections and other electrical components that may be mounted to the substrate. Other suitable material for the insulating layer may include a polymer such as polyimide.

In the illustrated embodiment, the first electrode 104 and the movable element 106 are disposed on the top surface of the substrate 102. The first electrode may be electrically connected to or electrically isolated from the substrate. The movable element 106 has a fixed portion 108, and a free portion 110, along its length. The fixed portion 108, that is one end of the movable element, is substantially anchored to the substrate 102 and the free portion 110 is released from the substrate. The free portion 110 of the movable element includes the second electrode 112 at opposite end to the fixed portion 108. The surface area and configuration of the movable element may be as required to generate the desired electrostatic forces to operate the high voltage device.

The first electrode 104 and the second electrode 112 may be formed of any conductive material. Materials that may be used for the first and the second electrodes include, for example, copper, tungsten, aluminum, gold, tantalum and alloys containing any of these. The first and the second electrodes may be platinum coated to have better thermomechanical characteristics.

MEMS/NEMS switches typically include the movable element 106, which can be fashioned in various geometries. One of the possible geometries is the "cantilever" geometry, in which a suspended connecting member is in the form of a beam that is anchored to an underlying substrate at a location substantially close to one of the ends of the beam. Another possible geometry is the "torsional element", in which a suspended connecting member, such as a beam, is anchored to an underlying substrate at a location substantially removed from each of its ends. Another possible geometry is the "bridge" geometry, in which a suspended connecting member is anchored to an underlying substrate at two locations, both of which are substantially towards the ends of the beam. Yet another possible geometry is the "membrane" geometry, in which a suspended connecting member is in the form of a flexible sheet that is anchored to an underlying substrate at multiple and possibly a continuum of points along its periphery. Yet another possibility is the "thermal actuator", which generates motion by thermal expansion amplification. It is possible to have combinations of the above possible geometries, as well.

The movable element 106 carries the electrical current. The movable element 106 may be constructed from a conductive material such as copper, tungsten, aluminum, gold, tantalum and alloys containing any of these.

According to an embodiment of the invention, referring to FIG. 1, an electric field may be applied between the control electrode 114 and the movable element 106. In the illustrated embodiments, the moveable element 106 deflects between a first position and a second position on application of the electric field, due to electrostatic actuation. The first position, herein, refers to a closed circuit and the second position refers to an open circuit. In first position, the switch is in "ON" state. The second electrode 112 is in conductive electrical communication with the first electrode 104 i.e. transfer of charge carriers occurs between the first electrode 104 and the second electrode 112 and thereby allows current to flow in the circuit. In second position, the second electrode 112 is electrically isolated from the first electrode 104, that is, no current flows in the circuit and the switch is in "OFF" state. When the electric field between the control electrode 114 and the movable element 106 of a first strength is applied, the movable element 106 moves down to the first position and the switch is in the "ON" state. Upon application of the electric field of a second strength, the movable element 106 moves up to the second position, and the switch is in the "OFF state".

The electric field of a first strength, herein, refers to an electric field that provides "pull-in voltage". The "pull-in voltage" may be defined as a minimum voltage applied to the control electrode required to electrostatically pulling down the movable element and thereby closing the circuit. The electric field of a second strength, herein, refers to an electric field that provides a voltage applied to the control electrode that is less than the "pull-in voltage".

For rapid switching of the order of microseconds, a voltage (charge) is quickly applied to and removed from the control electrode. A low resistance path is ideal for rapid switching. In other words, a highly conductive path is needed to quickly transfer the charge to the control electrode with little time delay. Suitable material for the control electrode may include copper, tungsten, aluminum, gold, tantalum, titanium, and alloys containing these metals. However, a high resistance path is required to prevent the control electrode and the movable element from touching and shorting the device. Thus, the protection layer 116 as illustrated in FIG. 1 is disposed over the control electrode 114. The protection layer 116 restricts the electrical communication between the control electrode 114 and the movable element 106, but does not fully eliminate it.

On application of a voltage between the control electrode and the movable element, that is during operation of the device, charge accumulates within the protection layer, thereby creating an internal electric field opposing an externally applied electric field between the control electrode and the movable element, and lowering the electric field required for electrostatic actuation. Thus, a greater voltage is required to attain an electric field sufficient to deflect the movable element for each successive switching operation. This successively delays the switching time. When the charge accumulation is such that it generates an internal electric field of the same magnitude as the applied electric field, the electrostatic attraction between the control electrode and the movable element neutralizes and the movable element can no longer be controlled.

The charge accumulation within the protection layer can be controlled by using a resistive protection layer on the control electrode. According to an embodiment of the present invention, the protection layer may have resistivity within a range from about 1 ohm-cm to about 10 kohms-cm. In one embodiment, the protection layer may have resistivity within a range from about 1 ohm-cm to about 10 ohms-cm. In one embodiment, the protection layer may have resistivity within a range from about 10 ohms-cm to about 100 ohms-cm. In one embodiment, protection layer may have resistivity within a range from about 100 ohms-cm to about 10 kohms-cm.

Thickness of the protection layer may be such that it does not disturb the electrostatic actuation between the control electrode and the movable element. The resistivity of the protection layer increases by decreasing the thickness of the layer. The thickness of the protection layer further affects the charge accumulation and also the breakdown voltage. In one embodiment, the protection layer may be less than about 10 micrometers thick. The thickness of the protection layer may be less than about 1 micrometer, in some exemplary embodiments, and less than about 0.5 micrometers in other embodiments. For example, the protection layer of about 0.1 micron thickness may breakdown at about 60 volts, in a certain embodiment. In exemplary embodiments, the breakdown voltage for about 0.2 micron thick protection layer may be about 120 volts and for about 0.3 micron thick protection layer, the breakdown voltage may be about 150 volts.

In one embodiment, the protection layer includes an anodized material. Examples of materials suitable for use as the anodized material for the protection layer include a material having dielectric constant less than about 20. Oxides of a metallic material, typically may have suitably low dielectric constant for use in embodiments described herein, for instance. Suitable oxides may include hafnium oxide, zirconium oxide, titanium oxide and tantalum oxide. In particular embodiment, the anodized material includes tantalum oxide.

In alternate embodiment, the protection layer includes an organic material. The organic material may be a polymer having resistivity in a range from about 1 ohm-cm to about 10 kohms-cm. In an exemplary embodiment, the polymer may be a semiconductor polymer such as conjugated polymer selected from the group used in light emitting diodes (LEDs).

Various methods can be used to deposit the protection layer over the control electrode. In particular embodiment, the protection layer may be disposed by anodizing a metal. In one embodiment, the control electrode can be anodized to form the protection layer. In another embodiment, a metal layer is first deposited over the control electrode and anodized to form the desired anodized material, as described above.

In one embodiment, the protection layer may be fully anodized. In another embodiment, the protection layer may be partially anodized having an unanodized region and an anodized region. The unanodized region may include unanodized metal and the anodized region may include the anodized material. The anodized region may fully cover the unanodized region and, thus, may provide required resistivity and electrically insulative properties at surface of the protection layer. The unanodized region may have low electrical resistance, which may enable electrical communication between the control electrode and the movable element while protecting the highly conductive path with the resistive anodized protection layer. Such protection layer prevents the charge accumulation within the protection layer and makes it leaky. Thus, due to presence of low resistive unanodized material, charge buildup within the protection layer may be avoided.

In a further embodiment, a system includes a circuit board having a plurality of electrostatically activated devices, as described above. The plurality of devices is in electrical communication with one another. The circuit board further includes components forming the arc limiting circuitry, which may include, but not limited to, diodes, inductors, resistors, in combination with the devices arranged in specific topologies. The systems may be used for variety of applications such as motor starters, smart starters, protection circuits, arc less switching, broadband blocking networks in MRI and the like. In particular embodiment, the system may include high voltage switching applications.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A device comprising:

a substrate;

a first electrode disposed on the substrate;

a movable element comprising a second electrode; and a control electrode comprising a protection layer, the control electrode disposed in electrostatic communication with the movable element, wherein the protection layer has resistivity in a range from about 1 ohm-cm to about 10 kohm-cm, wherein the movable element is deflectable between a first position in which the second electrode is in conductive electrical communication with the first electrode in response to an electrical field of a first strength established between the control electrode and the movable element, to a second position in which the second electrode is electrically isolated from the first electrode in response to an electrical field of a second strength established between the control electrode and the movable element.

2. The device of claim 1, wherein the device is a MEMS device or a NEMS device.

3. The device of claim 1, wherein the protection layer has resistivity in a range from about 1 ohm-cm to about 10 ohm-cm.

4. The device of claim 1, wherein the protection layer has resistivity in a range from about 10 ohm-cm to about 100 ohm-cm.

5. The device of claim 1, wherein the protection layer has resistivity in a range from about 100 ohm-cm to about 10 kohm-cm.

6. The device of claim 1, wherein the protection layer comprises a material having a dielectric constant less than about 20.

7. The device of claim 1, wherein the protection layer comprises an anodized material.

8. The device of claim 7, wherein the protection layer comprises an oxide, nitride, titanate, or silicate.

9. The device of claim 7, wherein the protection layer comprises tantalum oxide.

10. The device of claim 1, wherein the protection layer comprises an organic material.

11. The device of claim 1, wherein the protection layer has a thickness of less than about 10 micrometers.

12. The device of claim 1, wherein the protection layer has a thickness of less than about 1 micrometer.

13. The device of claim 1, wherein the protection layer has a thickness of less than about 0.5 micrometer.

14. The device of claim 1, wherein the movable element is a membrane, cantilever, beam, torsional element, or thermal actuator.

15. The device of claim 1, wherein the movable element comprises a conductive material.

16. The device of claim 1, wherein the control electrode comprises a metal selected from a group consisting of copper, tungsten, aluminum, gold, tantalum, titanium and alloys containing any of these metals.

17. A system comprising: a circuit board, a plurality of electrostatically activated devices disposed on the circuit board, wherein each of the electrostatically activated device comprises: a substrate; a first electrode disposed on the substrate; a movable element comprising a second electrode; and a control electrode comprising a protection layer, the control electrode disposed in electrostatic communication with the movable element, wherein the protection layer comprises anodized tantalum oxide, wherein the movable element is deflectable between a first position in which the second electrode is in conductive electrical communication with the first electrode in response to an electrical field of a first strength established between the control electrode and the movable element, to a second position in which the second electrode is electrically isolated from the first electrode in response to an electrical field of a second strength established between the control electrode and the movable element, wherein the protection layer has resistivity in a range from about 1 ohm-cm to about 10 kohm-cm.

18. The system of claim 17, wherein the plurality of electrostatically activated devices are in electrical connection with one another.

19. A method comprising:

providing a substrate;

providing a first electrode disposed on the substrate;

providing a movable element, the movable element comprises a second electrode; and providing a control electrode comprising a protection layer, the control electrode disposed in electrostatic communication with the movable element, wherein the protection layer has resistivity in a range of from about 100 kohm-cm to about 100 Mohm-cm.

20. The method of claim 19, wherein providing a control electrode comprises disposing a metal layer over the control electrode.

21. The method of claim 20, wherein providing a control electrode further comprises anodizing at least a portion of the metal layer to develop the protection layer over the control electrode.

* * * * *